343-700 MS AU 251 EX
4/24/84 OR 4,445,121

343/700MS United States Patent [19]

Hancock et al.

[11] 4,445,121

[45] Apr. 24, 1984

[54] SINGLE MEMBRANE LENS FOR SPACE RADAR USING MICROSTRIP ANTENNA RADIATING ELEMENTS

[75] Inventors: Joseph P. Hancock; Robert R. Henry, both of San Diego, Calif.

[73] Assignee: General Dynamics Corporation/Convair Div., San Diego, Calif.

[21] Appl. No.: 332,132

[22] Filed: Dec. 18, 1981

[51] Int. Cl.[3] ..... H01Q 1/28; H01Q 1/38

[52] U.S. Cl. ..... 343/700 MS; 343/853; 343/DIG. 2

[58] Field of Search ..... 343/700 MS, 915, DIG. 2, 343/853

[56] References Cited

U.S. PATENT DOCUMENTS 3,121,230 2/1964 Brueckmann ..... 343/700 MS
3,987,455 10/1976 Olyphant ..... 343/700 MS
4,030,102 6/1977 Kaplan et al. ..... 343/915
4,378,558 3/1983 Lunden ..... 343/DIG. 2

*Primary Examiner*—Eli Lieberman
*Attorney, Agent, or Firm*—John R. Duncan; Frank D. Gilliam

[57] ABSTRACT

A lightweight single layer microstrip membrane antenna for space radar applications which, in an exemplary application, is adapted to be furled on a spool and carried into space by a space shuttle orbiter where it is easily unfurled to form an antenna. The membrane antenna includes gore sections which are connected by metal mesh members that are folded in the furling process to avoid folding of the gore sections. The metal mesh members may also act as primary power busses for suitable transmit/receive antenna modules that are connected to series strings. Current regulators and zener diodes are connected in the strings of antenna modules to provide for continued operation of the antenna in the event of failure of antenna modules.

15 Claims, 13 Drawing Figures

SINGLE MEMBRANE LENS FOR SPACE RADAR USING MICROSTRIP ANTENNA RADIATING ELEMENTS

BACKROUND OF THE INVENTION

This invention relates to improvements in antennas for space radar applications, and more particularly, but not by way of limitation, to a single membrane lens for space radar using microstrip radiating elements.

In connection with work being performed on on-orbit assembly of space structures for space exploration programs, attention has been given to the design of large space based feed-through lens concepts. Prior to the present invention the only lens design that had been developed presented a number of potential problems associated with production, deployment and on-orbit operations.

A number of necessary goals have been achieved by the present invention. First, it was required that the lens have a thin design and be light in weight. It would then be possible to optimize the use of the space available in a space craft, such as the shuttle orbiter, and to obtain as large an antenna aperture as possible and to have the largest number of transmit/receive antenna modules that could be reasonably accommodated by the lens. At the same time it would be required to maintain the requisite structural integrity and rigidity of the lens structure.

The present invention also provides ease of packaging and deployment in space. Since the single membrane lens will be transported into space the lens must be able to be packaged within the volume and environment constraints imposed by the spacecraft, for example, the present shuttle orbiter.

Therefore, the single membrane lens of the present invention must be able to survive the launch acceleration, vibration and thermal stresses and must also provide for outgassing during ascent. For a sucessful application in space the lens design and packaging concept of the present invention must be able to be successfully deployed in an automated and controlled manner. The invention, by employing low profile antenna elements without sharp edges or protusions which could cause interlayer shear forces, lens/antenna snagging, or tearing or mechanical interferences, reduces deployment complexity and potential operational problems during deployment.

Once deployed, the lens of the present invention must be able to meet and to maintain during its operational life a predetermined physical and dimensional stability for operation in the GHz range. Such an operational performance requirement requires meeting predetermined standards of flatness upon deployment, elimination of creases in the lens due to folding of the material, relative insensitivity to solar or other thermally generated distortion, insensitivity to absorption and/or entrapment of fluids, and a resistance to degradation over its desired operational life. In the course of meeting these requirements, the lens must also incorporate an RF ground plane providing a 25 db or greater isolation between transmit and receive sides over the full aperture surface of the antenna.

Prior to the advent of the present invention, a lens antenna design did not exist that permitted a generic design that would be applicable to many applications. The present invention, however, is intended to be generic in nature so as to be able to accommodate almost any antenna shape and spacecraft structure and permit flexibility as well in the method of packaging which for example, may be folding or rolling the lens on a spool. While the illustrated embodiment of the invention is specifically directed to a large space based radar application, the invention would also be compatible with communication, radiometry or a combination of such applications.

In satisfaction of these objects the present invention is directed toward a single layer lens construction. Due to the large number of lens mounted components and the very large number of manufacturing steps involved to ensure that the antenna meets all physical and operational requirements, fabrication of antennas 20–100 meters in size has been considered as a critical technology area because of the lens material involved. Thus, a necessary aspect of the invention is that it must lend itself to a high degree of automated assembly and fabrication which it is believed is the essential difference between a practical and affordable lens system and one which is not. It is believed that the requisite design requirements of a lens system heretofore set forth have been achieved in the present design.

SUMMARY OF THE INVENTION

Briefly, the present invention contemplates a lightweight single layer microstrip membrane antenna for space applications that includes a plurality of thin lightweight gore sections adapted to act as an RF ground plane and configured to be furled into a stowed position without folding thereof in a longitudinal direction. A plurality of metal mesh members are secured to the gore sections and are adapted to be folded without creasing when the antenna structure is folded and furled into a stowed condition. The metal mesh members cooperate with the gore sections when the antenna is deployed to provide a tensioned unitary single plane membrane antenna.

A plurality of transmit/receive modules are integrated into each gore section, each module having at least one radiator coupled thereto, and are adapted to be supplied by appropriate prime power sources to provide a single lens membrane for a space based radar application.

The transmit/receive modules are connected in series in a plurality of parallel load strings to primary and negative power busses. A load regulator is connected in series in each string and zener diode is connected in parallel with each module. The load arrangement provides power efficiency and fault isolation.

Other objects and advantages of the invention will be evident from the following detailed description, when read in conjunction with the accompanying drawings which illustrate the invention.

DETAILED DESCRIPTION OF THE DRAWINGS

Figure 1:
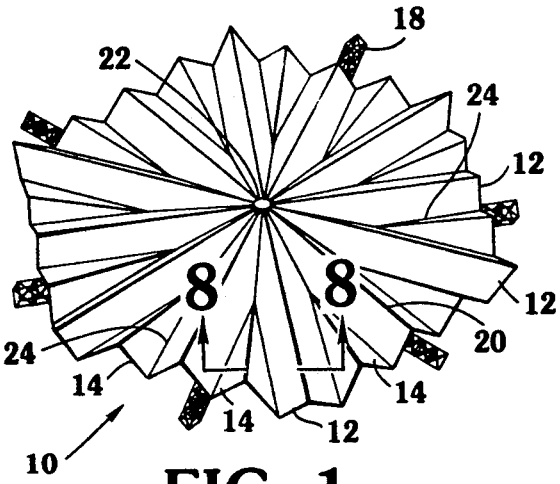
FIG. 1 is pictorial representation of a partially deployed single lens membrane antenna embodying the invention.

Referring now to the drawings in detail, and particularly FIG. 1, reference character 10 designates one embodiment of a lightweight single layer microstrip membrane antenna constructed in accordance with the present invention. In FIG. 1, the antenna 10 is shown in a partially deployed position. It will be seen that the antenna 10 includes a plurality of major gore sections 12 and a plurality of minor gore sections 14 which are inter connected in a novel manner as will be described in greater detail hereinafter.

Figure 2:
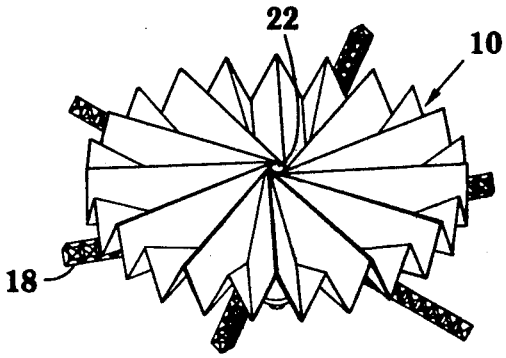
FIGS. 2 and 3 illustrate preceding steps in the partial deployment of a stowed single lens membrane antenna.
Figure 3:
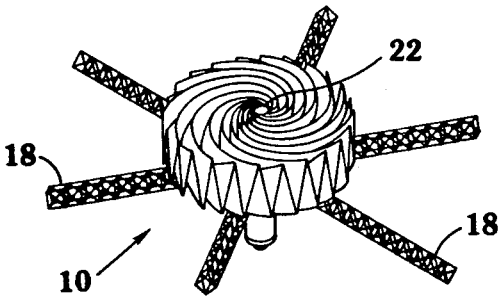
Figure 4:
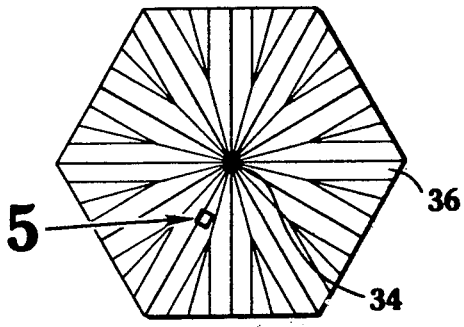
FIG. 4 is a plan view of a diagrammatic illustration showing a simplified diagram of electrical circuit of the present invention.

Referring now to FIGS. 1, 2 and 3 the antenna 10 is seen in a partially unfurled condition after having been transported into space by an appropriate spacecraft (not shown). After entering into a predetermined orbit in space the antenna 10, in its furled or stowed condition, is removed from the interior of the spacecraft for deployment. In FIG. 2 it will be seen that the antenna 10 is positioned on a suitable primary structure which is provided with suitable primary power sources, maneuvering equipment, control equipment, and any other equipment as may be required to maneuver and operate the antenna 10 in outer space.

The primary structure is provided, in the illustrated embodiment, with a plurality of stub arms 18 which are folded against the antenna 10 during transit and which are folded outwardly and locked into place, as seen in FIG. 2, upon deployment of the antenna 10 in space. After the arms 18 have been locked into place as seen in FIG. 2 the unfurling of the stowed antenna commences. As the antenna 10 is furled around the central drum 22 it will be understood that the antenna is provided with a plurality of minor fold lines 24 between the minor gore sections 14 and the major gore sections 12 and between the minor gore sections 14 alone. As seen in FIG. 3, as the antenna 10 is unfurled by any suitable means (not shown) the gore section 12 and 14 of the antenna 10 extend outwardly along the arms 18.

Figure 8:
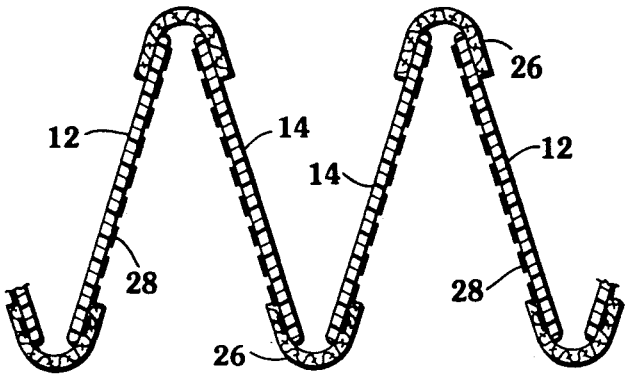
FIG. 8 is a partial cross section of the lens membrane of FIG. 1 as taken along the lines 8—8.
Figure 9:
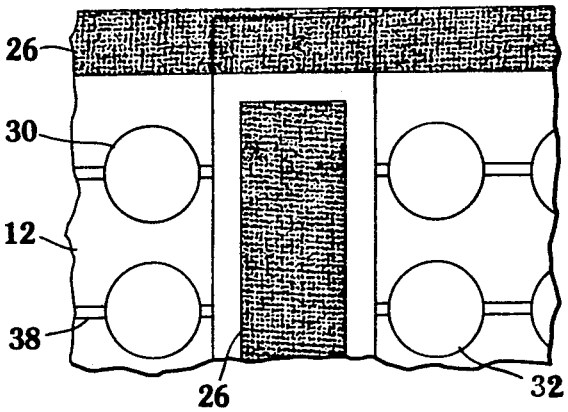
FIG. 9 is a partial plan view showing in greater detail the mechanical construction of the detail view of FIG. 5.

Referring now to FIGS. 8 and 9, greater detail of the physical construction of the antenna 10 will be shown. As seen in FIG. 8 the gore sections 12 and 14 are interconnected by a suitable metal mesh material 26 along which the fold lines 20 and 24 are made thereby avoiding the possibility of creasing the gore sections 12 and 14 during furling of the antenna 10 and impairing either the physical or electrical characteristics thereof. The mesh material 26 preferably comprises knitted wire mesh fabric that is knitted in a such mesh size and pattern as has been employed in the past for expandable knitted metal meshes. The material 26 can be fabricated from almost any metal that is reasonably ductile and which possess the required electrical characteristics.

The antenna 10 may be tensioned against the extended arms 18 by providing a uniform pull around the periphery thereof and stretching the membrane assembly of the antenna 10 against the rigid structure provided by the arms 18 so that the antenna then becomes taut, smooth, and wrinkle free. It is to be understood that once the antenna 10 is secured to the arms 18 in an extended condition the tension may be rapidly applied to the antenna 10 around its outer periphery to draw it away from the center, or conversely, the single membrane lens 10 may be tensioned by providing a uniform pull towards the center of the lens. As noted the mesh material 26 permits accommodations of assembly tolerances during tensioning.

Figure 11:
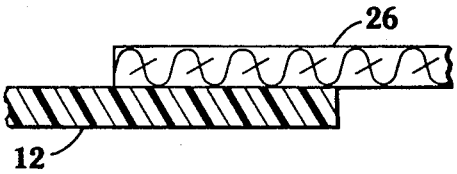
FIG. 11 is a partial cross section of the antenna structure illustrating in greater detail its construction.

As seen in FIG. 9, use of the mesh material 26 to interconnect the gore sections 12 and 14 permits the material 26 to yield as required to accomodate assembly tolerances when the antenna is unfurled to its fully deployed position. As seen in FIG. 11 the mesh material 26 is bonded to a gore section 12 by a suitable primer and adhesive. Referring now to FIG. 8, which is a partial cross sectional view taken along line 8—8 of FIG. 1, it will be seen more clearly how the gore sections 12 and 14 are folded along the mesh material 26 without creasing of the gore sections 12 and 14. The gore sections 12 and 14 are composed of a thin lightweight foldable, rollable material that is compatible with the space environment. The material, in addition to having high tensile strength and good mechanical properties, must be chemically stable throughout a large temperature range with no outgassing and not have too large a coefficient of thermal expansion.

At present the preferred material which meets these criteria (when subjected to nuclear and UV radiation) is a plastic material selected from a class of polymides. Among the different kinds of polymides, the one most preferred at present is polymide plastic sold under the trade name KAPTON by the Dupont Company. At present a thickness of 2 mils is preferred.

In FIG. 8, it will be seen that the gore sections 12 and 14 are provided on one common surface thereof with a very thin metal sheet 28. The metal sheet 28 which is preferably copper or aluminum is evaporated onto the sections 12 and 14, although the sheets may be glued onto the sections 12 and 14. The sheet 28 is designed to act as an RF ground plane for the antenna system 10 with the thickness of sheet being determined by the ease of electrical grounding thereto but a general order of thickness will be in microns.

Figure 12:
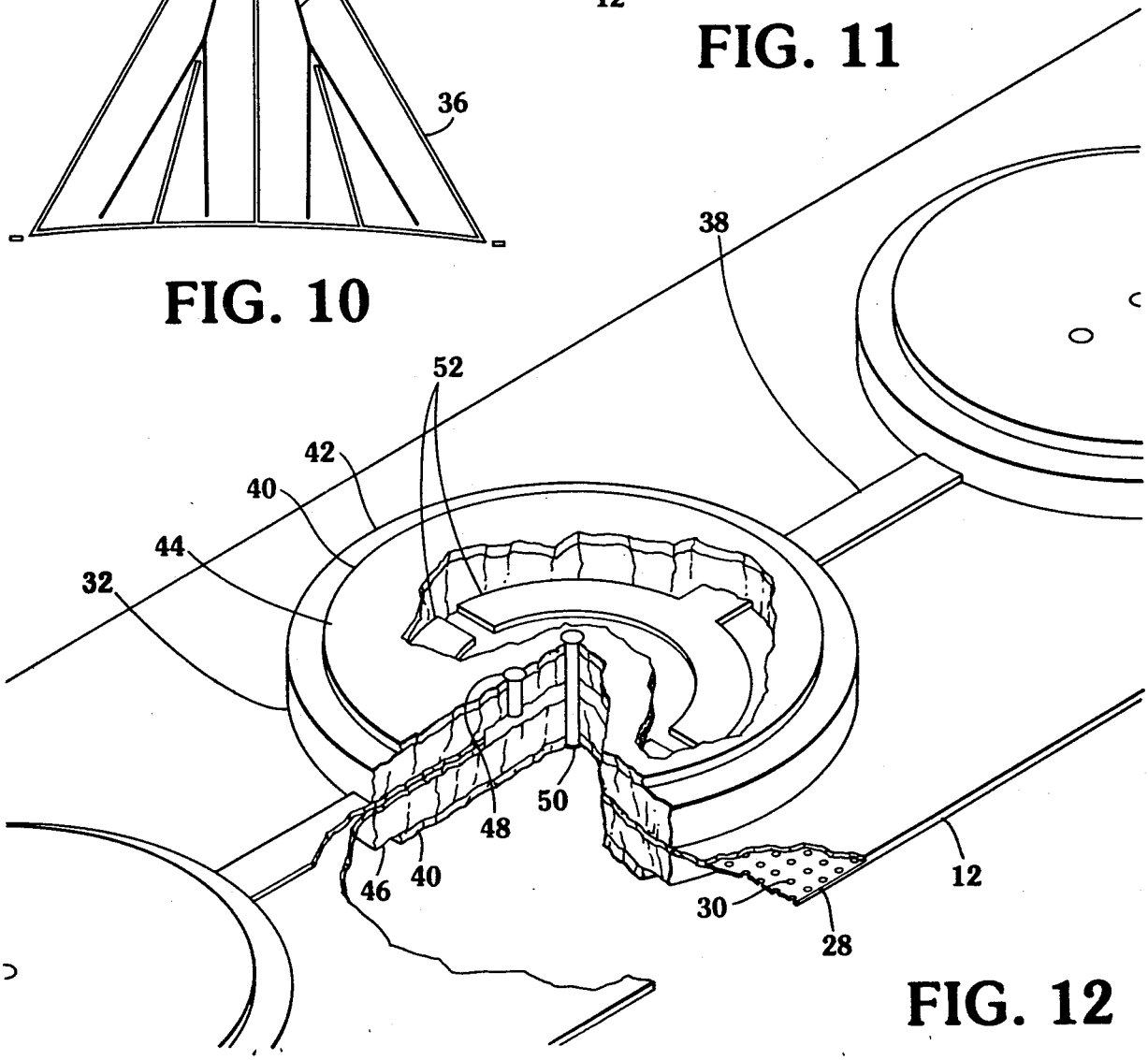
FIG. 12 is a perspective detail showing in greater detail of the ground plane shown in FIG. 9.

Although, for ease of illustration the perforations have been omitted in many of the FIGS. hereof, it is to be understood that the gore section 12 and 14 as seen in FIG. 12 are preferably provided with a plurality of perforations 30 to preclude propagation of tears. A polymide plastic sheet tears when subjected to a predetermined force and such tear propagates at a substantially less force. By perforating the sections 12 and 14 a rip-stop method has been incorporated since if a meteoroid, for example, starts a tear it will soon feed into a perforation and stop. Another method of accomplishing rip-stop is to place a scrim fabric between the ground plane 28 and the plastic film of the sections 12 and 14.

Figure 5:
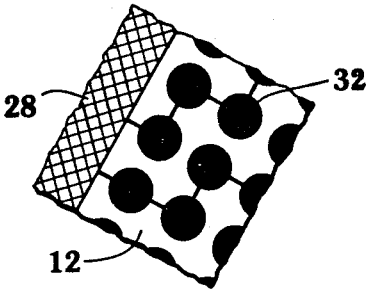
FIG. 5 is a detailed view of the antenna shown in FIG. 4 and illustrating in greater detail the electrical connections.
Figure 10:
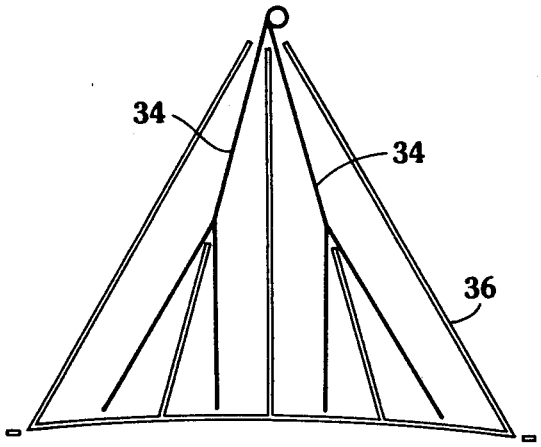
FIG. 10 is a simplified circuit of the antenna system illustrating an arrangement of the power busses.

A plurality of transmit/receive (T/R) modules 32 are integrated into each of the gore sections 12 and 14 as seen in FIG. 5 are electrically connected together, as will be described in greater detail hereinafter. As seen in FIGS. 9 and 10 the mesh material 20 may be utilized to provide positive DC power busses 34 and negative DC power busses 36 to which arrays of the T/R modules 32 are connected. It would also be within the scope of this invention to provide power busses that are separate from the mesh material 26. The positive and negative power busses 34 and 36 are electrically isolated by a dielectric mesh material (not shown) as may be required.

The microstrip antenna modules, as seen in FIGS. 9 and 12, are electrically connected to each other in predetermined arrays and to the power busses provided by the mesh material 26 by suitable leads 38. Each microstrip T/R module comprises annular complementary upper and lower radiator 40/dielectric 42 subassemblies 44 and 46 that are electrically coupled to the power leads 38 by suitable feed lines 48 connected to the module RF output. The ground plane 28 is grounded to a radiator 40 at its center by a pin 50 which also conducts heat away from the module 32 with the heat being radiated by the disc. Normally the radiator 40 is about one-half wavelength in diameter and placed about 0.150 inch above ground plane 28. The location of the feed pins 48 are determined in conjunction with the needs of the T/R module 32. Normally, this distance is about one-third of the disc 40 radius for a 50 ohm impedence match. One half of the volume of a module 32 is placed on one side of the ground plane so as to allow the tuning of the antenna to be identical.

The power leads 38 are provided with complementary semicircular extensions 52 to which the leads 48 are connected to permit indexing and correct orientation of each radiator 40, thus, RF signal polarization of each gore is parallel with all other gores.

Figure 13:
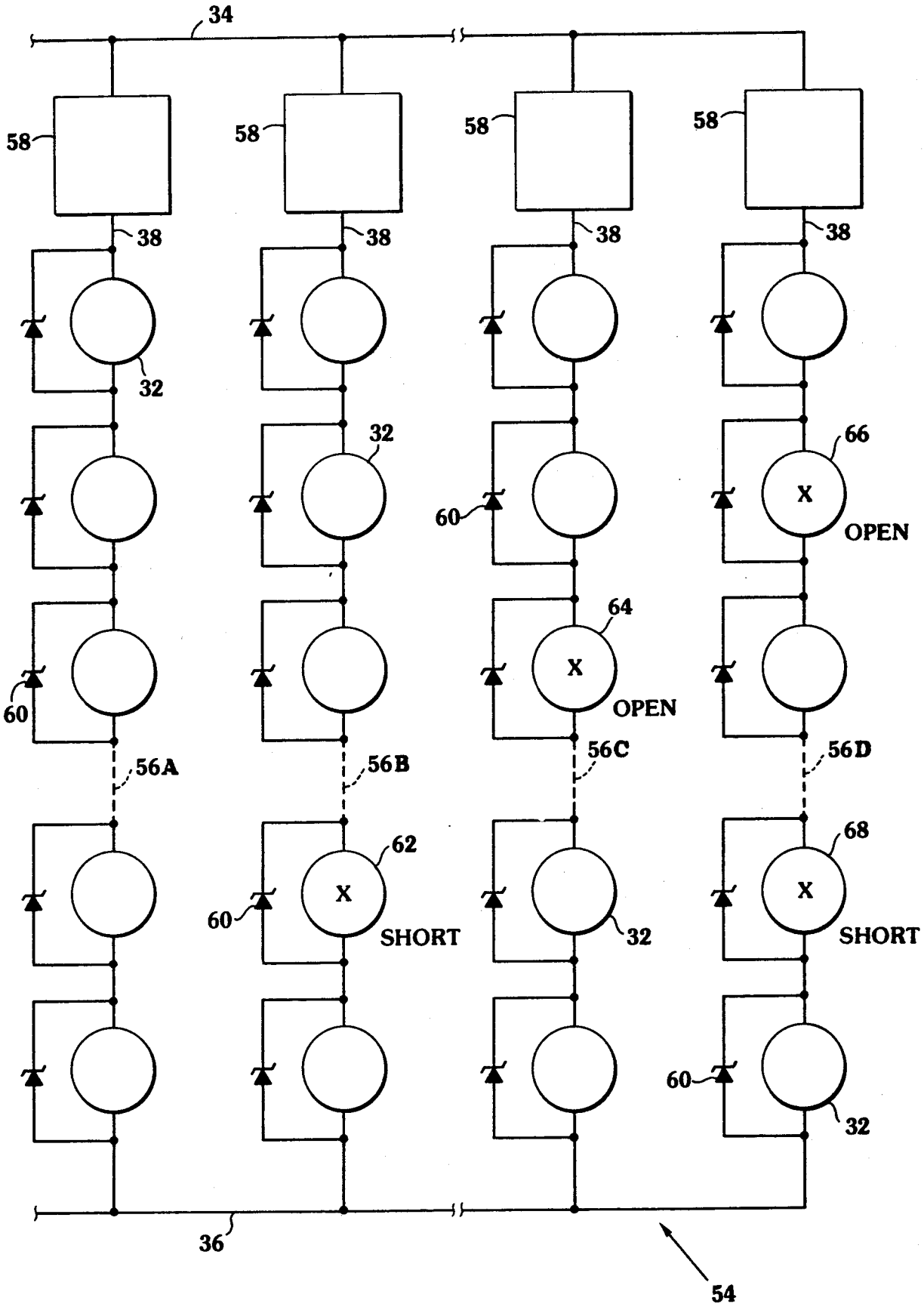
FIG. 13 is a simplified circuit diagram showing a preferred load arrangement of the antenna system of the present invention.

Referring now to FIG. 13, a series-parallel load arrangement 54 is shown and provides for the optimum distribution of electrical power to a large number of equal leads distributed over a large area. Objects of the power distribution system 54 of the antenna 10 are efficiency, tolerance to random load short and open faults, and minimum weight, especially for space applications. It is believed that these objects have been achieved by the novel load arrangement 54.

The load distribution system 54 includes a positive power bus 34 and a negative power bus 36 connected to a suitable power source (not shown). A plurality of T/R modules 32 are connected by power leads 38 into an "n" number of module strings 56A, 56B, 56C, and 56D which illustrate the four modes of operation. A suitable current regulator 58 is connected in series in each lead string 56 and a suitable zener diode 60 bridges each T/R module 32 in each string 56.

Looking now at load string 56A it will be seen that in normal operation all of the regulators 58 would operate with only a small drop and the zener diodes 60 would not be activated at all. Therefore, there would be little change in efficiency and the regulators 58 would compensate for the small differences in voltage delivered at different points by the bus system.

If, however, a load or T/R module 32 is shorted at point 62 the regulator 58 in load string 56B would place an equivalent load voltage drop in the string 56B so that the other modules would continue to receive their proper voltage and current. If a load opened up, for example as shown at point 64 in lead string 56C the zener diolde 60 bridging the opened T/R module 32 would be activated at a slightly higher voltage. The regulator 58 in string 56C would reduce its drop slightly to accomodate the increased voltage requirement and the other loads in the string would continue to receive their proper voltage and current.

In the event of a double failure as shown in load string 56D wherein an open occurs at point 66 and a short occurs at point 68 in a load 32, the voltage drop at the regulator 58 would increase to compensate for the short, but less than in string 56B due to the open fault. As before, the remaining loads would continue to receive their proper voltage and current. It is expected that the current regulators 58 would have fail-safe provisions, such as maximum current and maximum voltage drop limits, that would allow a normal string 56 to operate within reasonable limits with a "failed" regulator 58. Thus, the illustrated load distribution system would permit a large number of loads to be distributed over the whole aperture of the antenna 10.

Figure 6:
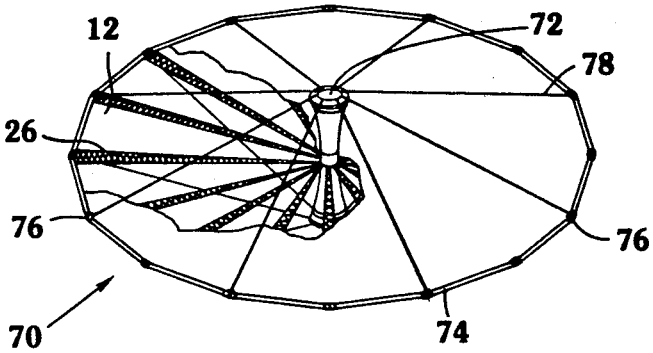
FIG. 6 is a simplified perspective illustrating how the single lens membrane antenna may be incorporated in a deployable wire wheel spacecraft design.
Figure 7:
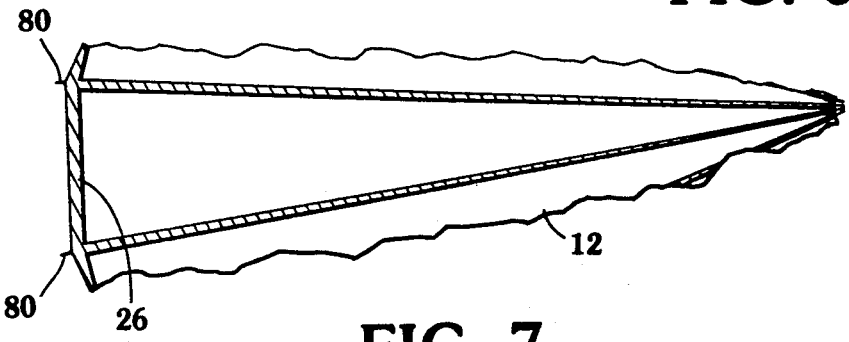
FIG. 7 is a partial view of a plan of a second embodiment of a single lens antenna embodying the present invention.

While one embodiment of the invention, as seen in antenna 10, has been described, the present invention is intended to be generic and is easily applicable to many other configurations of space frames. For example, in FIG. 6 it will be seen how the present invention is applied to deployable wire wheel spacecraft design. In the deployable wire wheel 70, a central spool or hub 72 has a plurality of major gore sections 12 attached to it, as before, and extending radially outwardly to be secured to a radial form tube or frame 74 which is formed with a plurality of hinges 76. A plurality of upper and lower stays 78 position the form tube 74 with respect to the central hub 72. The detail view of FIG. 7 shows that only major gore sections 12 are used in this embodiment and that the metal mesh material 26 interconnects such gores 12 as well as providing suitable attach points 80 for attachment to the form tube 74.

Changes may be made in the combination and arrangement of steps and procedures, as well as in the various elements of the appartus, without departing from the spirit and scope of the following claims.

What is claimed as new and useful and desired to be secured by United States Letters Patent is:

1. A lightweight single layer microstrip membrane antenna for space applications comprising;

a plurality of thin lightweight gore sections adapted to act as an RF ground plane and configured to be furled into a stowed position;

a plurality of metal mesh members positioned between the gore section's and secured thereto, said metal mesh members adapted to be folded without creasing along the fold when said antenna is furled into a stowed condition and to cooperate with said gore sections when the antenna is deployed to provide a tensioned unitary single plane membrane antenna, and a plurality of transmit/receive modules integrated into each gore section, each module having at least one radiator coupled thereto, and adapted to be supplied by appropriate prime power sources to provide a single lens membrane for a space radar.

2. The antenna of claim 1 wherein each gore section comprises a thin non-metallic material provided with a metallic reinforcement material that acts as RF ground plane.

3. The antenna of claim 2 wherein the non-metallic material is a polymide plastic and is provided with a plurality of regularly arranged small apertures.

4. The antenna of claim 1 wherein the gore sections are adapted to be furled around a central spool that has a height that is at least as long as the width of the widest gore section.

5. The antenna of claim 4 wherein each gore section has a generally pie shaped configuration and at least one side thereof is tangent to the central spool.

6. The antenna of claim 2 wherein the metallic reinforcement material is a thin metal sheet that is evaporated onto the non-metallic material.

7. The antenna of claim 2 wherein the metallic reinforcement material is a thin metal sheet that is adhesively bonded to the non-metallic material.

8. The antenna of claim 1 wherein each metal mesh member comprises a woven metal cloth material that is capable of yielding sufficiently to accommodate assembly tolerances when tensioned in a single membrane.

9. The antenna of claim 8 wherein a metal mesh member is positioned along the outer periphery of the membrane structure when the antenna is tensioned in a deployed position so as to provide a uniform tension across all directions of the gore sections when the membrane is so deployed.

10. The antenna of claim 1 wherein the metal mesh members are interconnected to provide negative and positive primary power busses for feeding the transmit/receive modules.

11. The antenna of claim 1 wherein each transmit/-receive module is nested between two microstrip radiator antenna discs to which it is coupled and separated therefrom by a suitable dielectric.

12. The antenna of claim 1 wherein the connection to each transmit/receive module from each prime power bus ends in a semicircular connection to which a power lead tab from said module is connected thereby permitting orientation of each module with respect to the membrane so that RF signal polarization of each gore is parallel with all other gores.

13. The antenna of claim 1 wherein the transmit/-receive antenna modules are connected in a plurality of series-parallel strings between the positive and negative primary power busses.

14. The antenna of claim 13 wherein each transmit/-receive antenna module has a zener diode connected in parallel therewith so that electrical current flow through the string may be maintained even if a transmit/receive antenna module is disabled.

15. The antenna of claim 14 wherein a current regulator is connected in series with each series string of transmit/receive antenna modules so that in the event of a failure of a transmit/receive antenna module the remaining loads representing the series string in which the failure had occurred and the other series strings would continue to receive their proper voltage and current.

* * * * *